US009469105B2

(12) United States Patent
Horie

(10) Patent No.: US 9,469,105 B2
(45) Date of Patent: Oct. 18, 2016

(54) LIQUID DROPLET EJECTION DEVICE, LIQUID DROPLET EJECTING METHOD AND INKJET RECORDING APPARATUS

(71) Applicant: Yasuyuki Horie, Kanagawa (JP)

(72) Inventor: Yasuyuki Horie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/735,905

(22) Filed: Jun. 10, 2015

(65) Prior Publication Data

US 2015/0352841 A1 Dec. 10, 2015

(30) Foreign Application Priority Data

Jun. 10, 2014 (JP) ..... 2014-119479
May 29, 2015 (JP) ..... 2015-110355

(51) Int. Cl.
*B41J 2/165* (2006.01)
*B41J 2/045* (2006.01)
(Continued)

(52) U.S. Cl.
CPC ..... *B41J 2/04588* (2013.01); *B41J 2/0451* (2013.01); *B41J 2/04581* (2013.01); *B41J 2/14233* (2013.01); *B41J 2/16526* (2013.01); *B41J 2/16579* (2013.01); *B41J 2/16585* (2013.01); *B41J 2/055* (2013.01); *B41J 2/165* (2013.01); *B41J 2/1652* (2013.01); *B41J 2/16517* (2013.01); *B41J 2002/14354* (2013.01); *B41J 2002/1657* (2013.01)

(58) Field of Classification Search
USPC ..... 347/5, 6, 9, 10, 11, 12, 13, 14, 19, 22
See application file for complete search history.

(56) References Cited

U.S. PATENT DOCUMENTS 6,357,846 B1 3/2002 Kitahara
7,328,960 B2 2/2008 Sakagami et al.
(Continued)

FOREIGN PATENT DOCUMENTS

EP 1600294 A1 11/2005
EP 1688258 B1 10/2010
(Continued)

OTHER PUBLICATIONS

Machine-generated translation of JP 05-024194, published on Feb. 1993.*
(Continued)

*Primary Examiner* — Huan Tran
(74) *Attorney, Agent, or Firm* — Duft Bornsen & Fettig LLP

(57) ABSTRACT

A liquid droplet ejecting device that includes multiple pressure chambers communicating with multiple nozzles, to contain liquid; a vibration plate, to constitute elastic walls of the pressure chambers, disposed extending along the pressure chambers; multiple pressure generating elements disposed facing the multiple chambers respectively via the vibration plate; a drive waveform generator to generate drive waveform data that indicates a shape of a drive waveform for driving the multiple pressure generating elements; a residual vibration detector to detect a residual vibration waveform occurring within the pressure chamber after the pressure generating elements are driven; and a controller to determine the necessity of liquid-state recovery ejection for discharging thickened liquid, based on the detected residual vibration, and to causes the liquid-state recovery ejection to be performed upon determining that liquid-state recovery ejection is needed.

19 Claims, 13 Drawing Sheets

(51) Int. Cl.
*B41J 2/14* (2006.01)
*B41J 2/055* (2006.01)

(56) References Cited

U.S. PATENT DOCUMENTS

| | | | | |
|---|---|---|---|---|
| 2004/0223027 | A1* | 11/2004 | Shinkawa et al. | 347/23 |
| 2004/0239714 | A1* | 12/2004 | Sakagami et al. | 347/19 |
| 2004/0252144 | A1* | 12/2004 | Higuchi et al. | 347/5 |
| 2005/0128232 | A1* | 6/2005 | Shinkawa | 347/10 |
| 2005/0212846 | A1* | 9/2005 | Shinkawa et al. | 347/19 |
| 2013/0307896 | A1 | 11/2013 | Shinkawa et al. | |

FOREIGN PATENT DOCUMENTS

| | | |
|---|---|---|
| JP | 05-024194 | 2/1993 |
| JP | 2000-037867 | 2/2000 |
| JP | 3867788 | 1/2007 |
| JP | 3933506 | 6/2007 |

OTHER PUBLICATIONS

Extended European Search Report of European Patent Application No. 15171406.0 dated Oct. 14, 2015.

* cited by examiner

LIQUID DROPLET EJECTION DEVICE, LIQUID DROPLET EJECTING METHOD AND INKJET RECORDING APPARATUS

CROSS-REFERENCE TO RELATED APPLICATIONS

The present application is based on Japanese Priority Application No. 2014-119479 filed on Jun. 10, 2014, and No. 2015-110355 filed on May 29, 2015, the entire contents of which are hereby incorporated herein by reference.

BACKGROUND

1. Field

The present invention relates to a liquid droplet ejection device, a liquid droplet ejecting method, and an inkjet recording apparatus.

2. Description of the Related Art

Inkjet recording apparatuses usually have been known as image forming apparatuses such as printers, facsimile machines, copiers, multifunction peripherals (MFP), etc. In the inkjet recording apparatus, an inkjet recording head, which includes nozzles to eject ink droplets, pressure chambers communicating with the nozzles, and piezoelectric elements to compress the ink in the pressure chambers, and form desired characters and figures on recording media (paper, metal, wood, and ceramics).

The ink in the pressure chamber is exposed to external air via the openings of the nozzles, which increase the viscosity of (thickens) the ink. In a proposed inkjet recording apparatus, by applying a slight vibration to meniscus (ink surface), the increase in the viscosity of the ink positioned near the openings of the nozzles, and ejecting the ink droplet is made stable. For example, see JP-2000-037867.

In addition, a technique in which ejection failure of the nozzles is avoided by discharging the ink whose viscosity has thickened is proposed. For example, there are a star-flushing technique where ink droplets having a size much smaller than visible in image forming regions and a line-flushing technique where ink droplets are ejected at constant intervals in no-image-forming regions.

In order to reduce running cost of an inkjet recording apparatus having a liquid ejecting device installed, it is necessary to alleviate the consumption of the ink.

However, in the conventional inkjet recording apparatus, even when the viscosity of the ink positioned near the openings of the nozzles has a suitable viscosity, ink droplets are discharged from all the nozzles. Therefore, the apparatus consumes ink wastefully, thereby adversely increasing the running cost.

SUMMARY

In view of the above circumstances, in one aspect, the present invention proposes a liquid droplet ejecting device enabling to reduce a running cost.

In an embodiment which solves or reduces one or more of the above-mentioned problems, the present invention provides the liquid droplet ejecting device that includes multiple pressure chambers communicating with multiple nozzles, to contain liquid; a vibration plate, to constitute elastic walls of the pressure chambers, disposed extending along the pressure chambers; multiple pressure generating elements disposed facing the multiple chambers respectively via the vibration plate; a drive waveform generator to generate drive waveform data that indicates a shape of a drive waveform for driving the multiple pressure generating elements; a residual vibration detector to detect a residual vibration waveform occurring within the pressure chamber after the pressure generating elements are driven; and a controller to determine the necessity of liquid-state recovery ejection for discharging thickened liquid, based on the detected residual vibration, and to causes the liquid-state recovery ejection to be performed upon determining that liquid-state recovery ejection is needed.

BRIEF DESCRIPTION OF THE DRAWINGS

A more complete appreciation of the disclosure and many of the attendant advantages thereof may be readily obtained as they become better understood by reference to the following detailed description when considered in connection with the accompanying drawings, wherein.

DETAILED DESCRIPTION OF THE PREFERRED EMBODIMENTS

Figure 1:
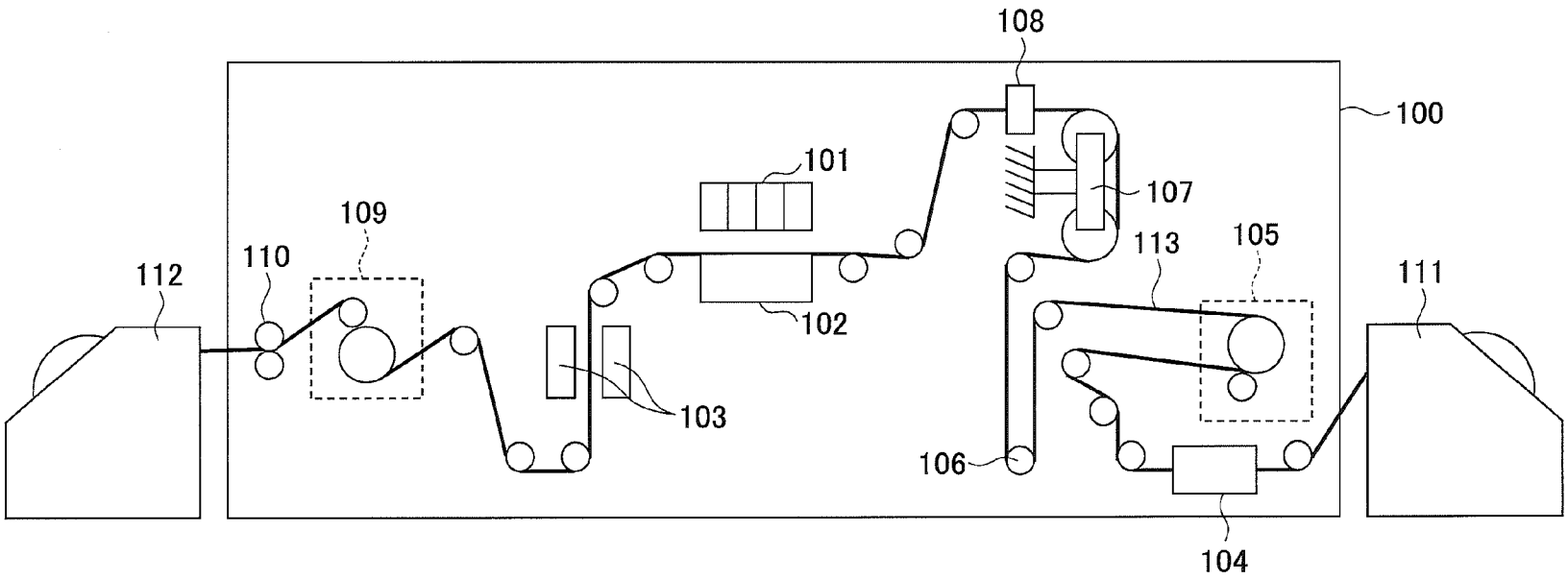
FIG. 1 is a schematic illustrating an entire configuration of an on-demand type line scanning inkjet recording apparatus according to embodiments of the present invention.

In the following, embodiments of the present invention will be described with reference to the accompanying drawings. It should be noted that configuration elements that include substantially the same functional configurations in the present specification and the drawings are assigned the same reference numerals and the duplicated description is omitted.

Below are described the embodiments of the present invention, with reference to figures. It is to be noted that, for ease of explanation and illustration, same configurations are represented by identical numerals and the description thereof is omitted below.

In the present, "idle discharge (liquid-state recovery ejection)" is also called "dummy discharge", "ejection for discarding", and flushing operation. "Idle discharge" means to discharge thickened ink whose viscosity is increased from nozzles, so as to recover ejection performance in the inkjet recording head.

In the present specification, an example in which a piezoelectric element is used as a pressure generating element to pressurize ink (liquid) in a pressure chamber is described. In addition, the piezoelectric element may be used for detecting a residual vibration.

<Inkjet Recording Apparatus>

First Embodiment

FIG. 1 is a schematic illustrating an entire configuration of a system including an on-demand type line scanning inkjet recording apparatus 100.

In the system shown FIG. 1, the inkjet recording apparatus 100 is disposed between a recording medium supply unit 111 and a recording medium collection unit 112. The inkjet recording apparatus 100 includes an inkjet recording device 101, a platen 102 provided facing the inkjet recording device 101, a drying module 103, and a recording medium conveying device.

The continuous recording medium (roller paper, continuous form paper) 113 is fed from the recording medium supply unit 111 at high speed and after printing operation, the recording medium 113 is reeled and collected in the recording medium collection unit 112.

The inkjet recording device 101 (inkjet recording module 200) includes a line head (recording head 220) in which print nozzles (ejection openings) 20 (see FIG. 4) are arranged in an entire of a printing width. Color printing is performed using the respective line heads for black, cyan, magenta, and yellow. In printing, nozzle surfaces of the line heads 220 are supported so that a predetermine gap is kept constant between the nozzle surfaces and the platen 102. The inkjet recording module 200 (101) ejects the ink in accordance with the conveyance speed of the recording medium 113, which forms a color image on the recording medium 113. The drying module 103 drying and fixing the ink on the recording medium 113 such that the ink printed on the recording medium 113 is not adhered to the other portion. The drying module 113 may be constituted by a non-contact type-driving device or contact-type drying device.

In the recording medium conveying device, a restriction guide 104, an in-feed unit 105, a dancer roller 106, an edge position controller (EPC) 107, a conveyance meandering detector 108, an out-feed unit 109, and a puller 110 are provided. The restriction guide 104 performs positioning of the recording medium 113 fed by the recording medium supply unit 111, in a wide direction thereof. The in-feed roller (unit) 105 consists of a drive roller and a driven roller, to keep a tension force of the recording medium 113 constant. The dancer roller 106 moves in a vertical direction and outputs a positioning signal by moving in the vertical direction in accordance with the tension force of the recording medium 113. The EPC 107 controls positions of edges of the recording medium 113. The conveyance meandering detector 108 is used for feeding back the meandering amount. The out-feed unit 109, including a driving roller and a driven roller, drives and conveys the recording medium 113 at a setting constant speed. The puller 110, including a driving roller and a driven roller, discharges the recording medium 113 outside of the inkjet recording apparatus 100. The recording medium conveying device, functioning as a tension-control type conveying device, detects the positions of the dancer roller 106 and controls the rotation of the in-feed unit 105, which can keep a tension force of the recording medium 113 during conveying.

Herein, a recovery operation to recover ejection performance of the head is described. During printing, since the ink in the pressure chamber is exposed to external air via the openings of the nozzles, the solvent of the ink is evaporated and the ink viscosity is increased (thickened), affected by the change in ambient temperature/humidity, and by self-heating while the head is continuously driven.

In addition, in a period except the printing, the ink in the pressure chamber is capped by a dedicated cap (moisture cap). However, even though a long time has elapsed in a state where the nozzle is capped, the viscosity of the ink is increased.

As a result, when the ink viscosities are changed among the nozzles, the ejecting speed of the respective nozzles vary, which may cause defective image formation such as image density fluctuation, image partly absent creating white lines, and color tone change. When the ink viscosity is further increased, the nozzle is clogged, and the image is formed with the ink partly absent, creating white dots.

In order to solve this problem and recover the ejection performance of the head, it is necessary to perform an idle discharge (liquid-state recovery ejection) that discharges the thickened ink from the nozzles. The idle discharge operation is performed by applying a drive waveform to an electrode of a connection substrate of the piezoelectric element and pressurizing the ink in the pressure chamber, using expansion and contraction of the piezoelectric elements.

The line scanning type inkjet recording apparatus 100 performs a star-flushing operation and a line-flushing operation (for example the idle discharge ink lands in a border between A4 papers), thereby discharging the thickened ink. The star-flushing operation has a demerit where it is less likely to obtain good effect of ink ejection for discarding, under the low-humidity environment and the ink landing on a small image (low duty) on the recording medium, but has a merit that no waste sheet is generated. The line-flushing operation has a demerit that it cannot help generating the waste sheet because cutting the area on which the ink droplet is landed is necessary, but has a merit that the thickened ink can be strongly ejected (discharged) for discarding.

Although details are described below, in the liquid-droplet ejecting head according to the present embodiments, after the surface (meniscus) of ink is vibrated (slightly driven) such that the ink is not on ejected, or after the ink is ejected, the residual vibration occurring within the ink in the pressure chamber is detected, and a drive voltage to be applied to the piezoelectric element is suitably controlled based on the thickness of the ink correlating to a damping ratio (attenuation ratio) of the residual vibration.

With this control, the ink droplet is discharged only from the nozzle from which the idle discharge is needed (nozzle where the viscosity of the ink near the opening is not within an appropriate range).

Accordingly, waste consumption of the ink is suppressed, and running cost in the inkjet recording apparatus having the liquid-droplet ejection device installed can be reduced.

Figure 2:
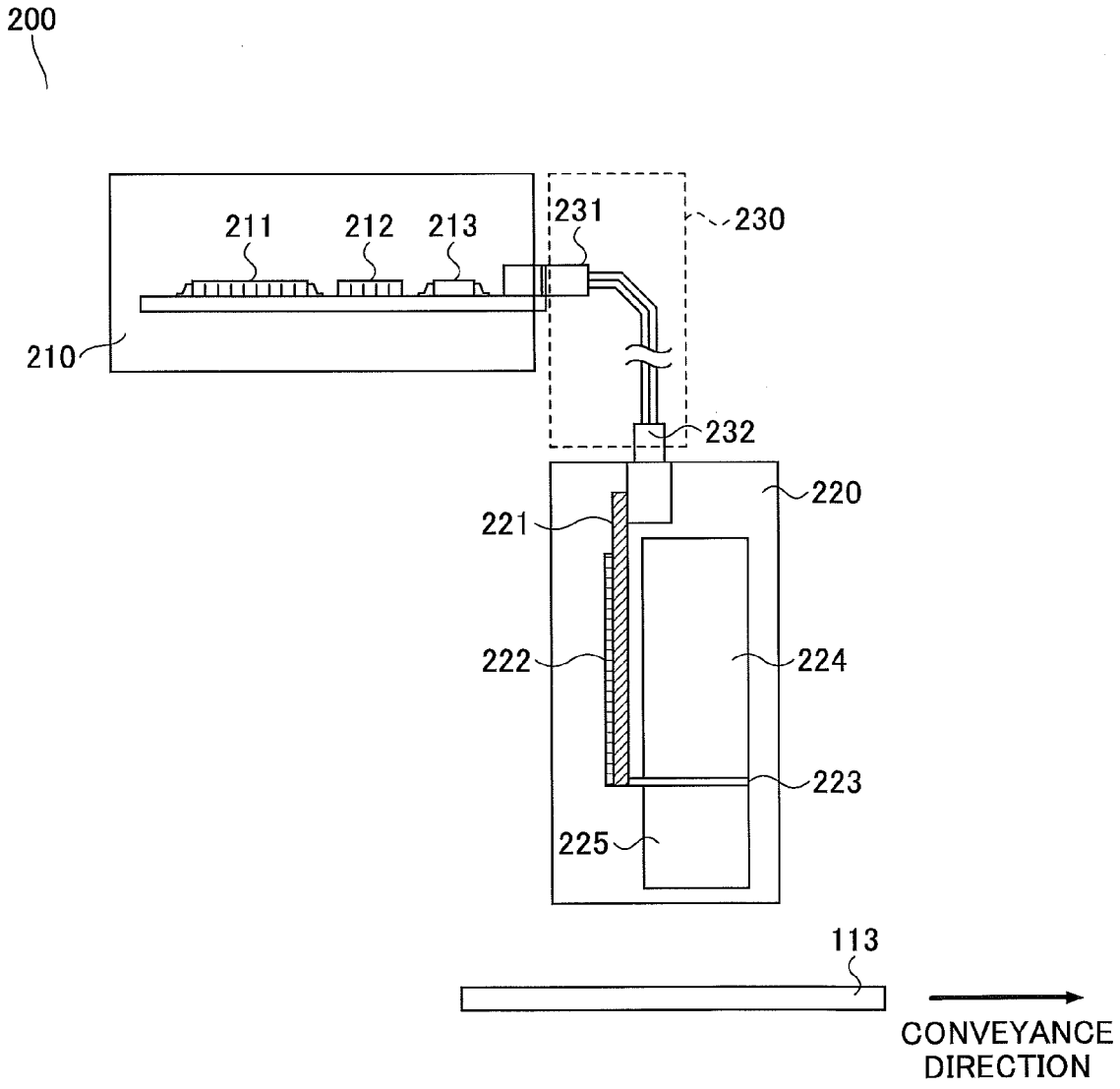
FIG. 2 is a side view illustrating a configuration of an inkjet recording module (liquid droplet ejecting device)

FIG. 2 is a side view illustrating a configuration of one example of the inkjet recording module 200 (recording device 101), to be installed in the inkjet recording apparatus 100.

As shown in FIG. 2, the inkjet recording module 200 mainly includes a drive control substrate 210, an inkjet recording head 220, and a cable 230.

The drive control substrate 210 is equipped with a controller 211, a drive waveform generator 212, and a memory 213. Furthermore, each of the inkjet recording heads 220 includes a head-side substrate 221, a vibration detecting substrate 222, a head driving IC substrate 223, an ink tank 224, and a rigidity plate 225. The cable 230 connects a drive-control substrate side connector 231 and a head side connector 232. By doing so, the drive control substrate 210 sends and receives an analog signal and a digital signal to and from the head-side substrate 221 via the cable 230.

Herein, in the line scanning type inkjet recording apparatus 100 that has a line head structure, one or multiple inkjet recording heads 220 are arranged in a direction orthogonal to a direction in which the recording medium 113 is conveyed. Herein, a line scanning type inkjet recording head 220 ejects ink droplet onto the recording medium 113, thereby enabling fast image forming. However, the structure of the inkjet recording apparatus 100 is not limited to the line scanning type; alternatively, a serial scanning type inkjet recording apparatus that, while the one or multiple recording head is conveyed to the direction orthogonal to the conveyance direction of the recording medium 113 to form the image, or others may be used.

Figure 3:
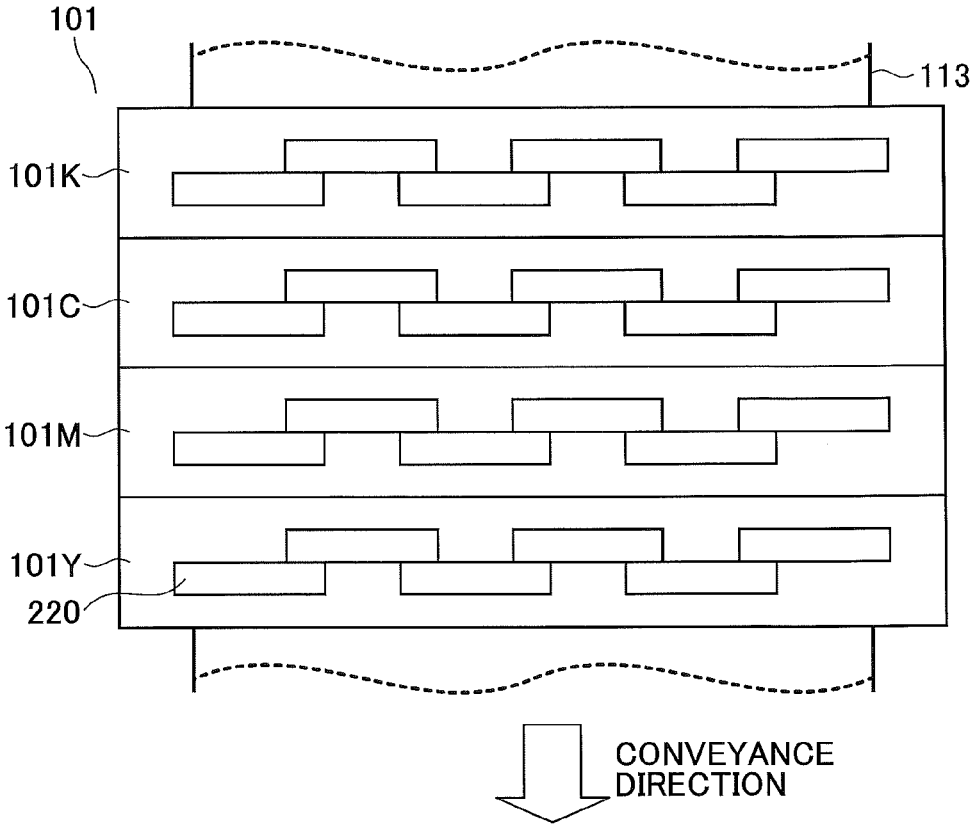
FIG. 3 is a schematic illustrating a recording device according the first embodiment.

FIG. 3 is a schematic illustrating the recording device 101, to be installed in the inkjet recording apparatus 100.

The recording device 101 shown in FIG. 3 is configured with an assembly of four head arrays 101K, 101C, 101M, and 101Y, where each head arrays 101K, 101C, 101M, and 101Y includes multiple inkjet recording heads 220. The head array 101K for black ejects black-color ink droplets, the head array 101C for cyan ejects cyan-color ink droplets, the head array 101M for magenta ejects magenta-color ink droplets, and the head array 101Y for yellow ejects yellow-color ink droplets.

The respective head arrays 101Y, 101C, 101M, and 101Y are arranged in parallel to the conveyance direction of the recording medium. Multiple inkjet recording heads 220 are disposed in zigzag, in the direction orthogonal to the conveyance direction. The inkjet recording heads 220 are configured as arrays as described above, which can ensure wide printing region.

Figure 4:
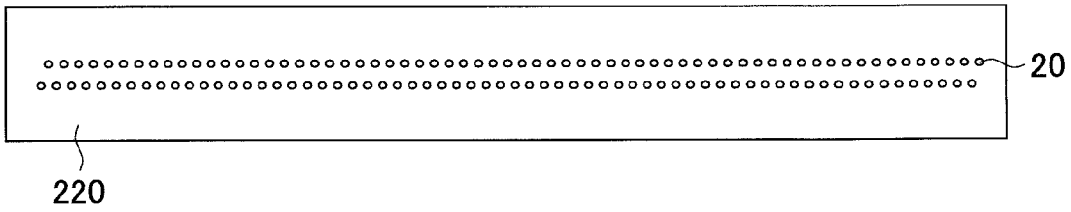
FIG. 4 is an enlarged bottom view illustrating an inkjet recording head according the first embodiment.

FIG. 4 is a bottom view illustrating an enlarged bottom of the inkjet recording head 220 in the head device shown in FIG. 3.

The inkjet recording head 220 includes multiple on nozzles 20, and the multiple nozzles 20 are arranged in zigzag in the direction orthogonal to the conveyance direction of the recording medium 10. Thus, a great number of print nozzles 20 are arranged in zigzag, which can cope with high resolution.

In the embodiment shown in FIG. 4, three inkjet recording heads 220 are arranged in one row, and an upper row and a lower row are arranged relative to each other like a zigzag. Further, 32 nozzles are arranged in one row, two rows are arranged in parallel, and the nozzles 20 in an upper row and the nozzles in a lower row are arranged relative to each other like a zigzag. This configuration is just one example, and the number of rows and the number in the array are not limited above.

Figure 5:
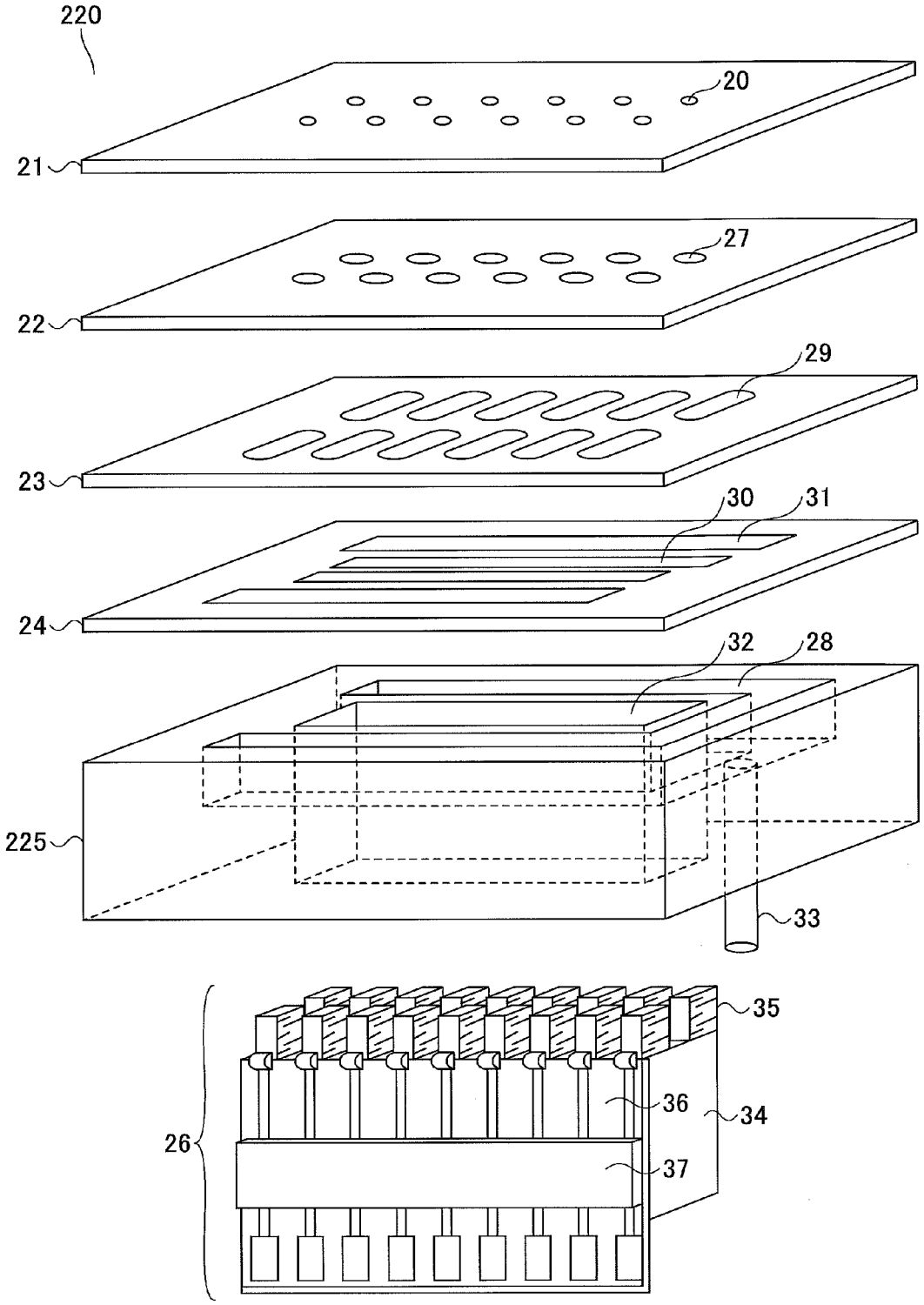
FIG. 5 is a configuration perspective diagram of the ink recording head according the first embodiment.

FIG. 5 is a configuration perspective diagram of the inkjet recording head 220, to be installed in the inkjet recording apparatus 100.

As shown in FIG. 5, the inkjet recording head 220 mainly includes a nozzle plate 21, a pressure-chamber plate 22, a restrictor plate 23, a diaphragm plate 24, a rigidity plate 25, and a piezoelectric-element group 26. The piezoelectric-element group 26 includes a supporting member (piezoelectric-element supporting substrate) 34, multiple piezoelectric elements 35, and piezoelectric elements driving IC 37.

Multiple nozzles 20 are formed in the nozzle plate 21. The pressure chamber 27, corresponding to the nozzles 20, are formed in the pressure chamber plate 21. The restrictor 29 is formed in the restrictor plate 23. The restrictor 29 is provided to communicate with the pressure chamber 27 and a common ink channel 28, to control the amount of ink flowing to the pressure chamber 27. The diaphragm plate 26 includes a vibration plate 30 and a filter 31.

The channel plate is configured by superimposing the nozzle plate 21, the pressure chamber plate 22, the restrictor plate 23, and the diaphragm plate 24 in this order, and then by performing the positioning and connecting the plates 21, 21, 23, and 24. By joining the channel plate to the rigidity plate 28, the filter 31 is placed facing an opening 32 of the common ink channel 28. An upper opening end of an ink guide pipe 33 is connected to the common ink channel 28. A lower opening end of the ink guide pipe 33 is connected to the head tank that the ink fills.

The multiple piezoelectric elements 35 are formed on the supporting member (piezoelectric-element supporting substrate) 34, and free ends of the piezoelectric element 35 are bonded and fixed to the vibration plate 30. The piezoelectric-element driving IC 37 is formed on the surface of the piezoelectric element connection substrate 36, where the piezoelectric-element driving IC 37 and the piezoelectric element connection substrate 36 are electrically connected to each other. Based on the drive waveform (for example, a drive voltage waveform) generated in the drive waveform generator 212, the piezoelectric-element driving IC 37 controls the piezoelectric element 35. The piezoelectric-element driving IC 37 is controlled based on the image data transmitted from the host controller (controller 120) of the inkjet recording apparatus 100, and the timing signal output from the controller 211.

For ease of illustration, FIG. 5 shows the nozzles 20, the pressure chambers 27, the restrictors 29, and the piezoelectric elements 35, where numbers thereof are less than actual numbers thereof.

[Detect Residual Vibration]

With reference to FIGS. 6 through 13, one example of the residual vibration detection in the liquid droplet ejecting device according to the present on embodiment is described.

Figure 6A:
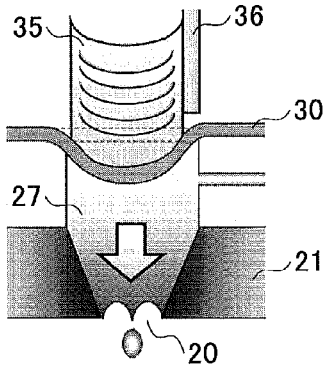
FIG. 6A is a schematic illustrating pressure change and operation of a residual vibration occurring within an individual pressure generation chamber of a print nozzle while ink is being ejected.
Figure 6B:
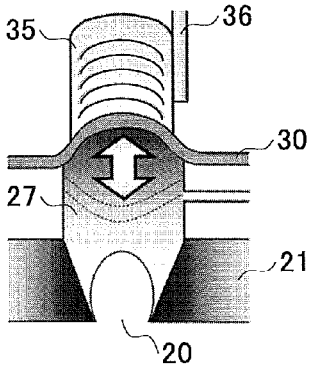
FIG. 6B is a schematic illustrating pressure change and operation of a residual vibration occurring within the individual pressure generation chamber of the print nozzle after ink has been ejected.

FIGS. 6A and 6B are schematics illustrating operation of the residual vibration waveform occurring in the pressure chamber 27 in the inkjet recording head 220. Specifically, FIG. 6A illustrates the pressure change occurring in the pressure chamber 27 while ink is being ejected. FIG. 6B illustrates the pressure change occurring in the pressure chamber 27 after ink has been ejected.

Figure 7:
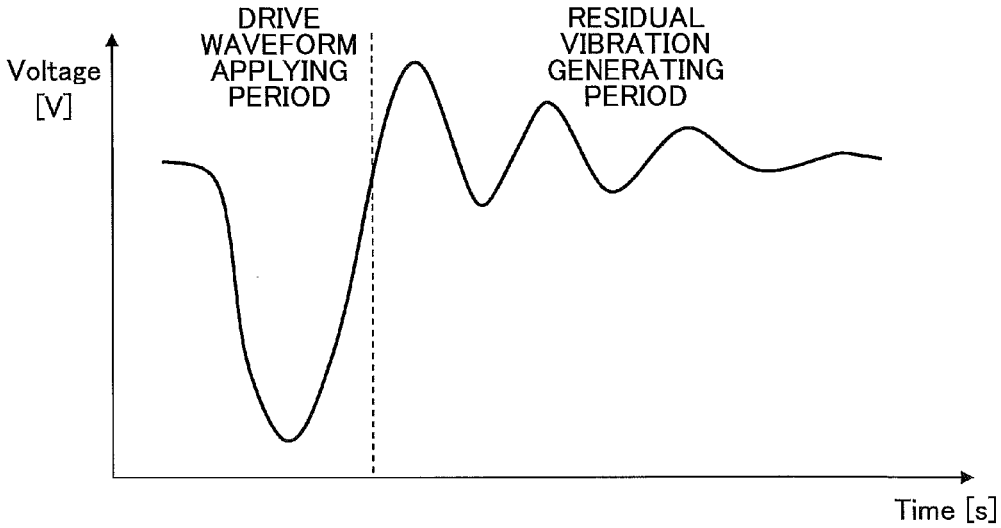
FIG. 7 is a graph schematically illustrating a drive waveform applying period and a residual vibration waveform generating period.

FIG. 7 is a graph schematically illustrating a drive waveform and a residual vibration waveform. In FIG. 7, a horizontal axis shows a time [s], and a vertical axis shows a voltage [V]. A drive waveform applying period in FIG. 7 corresponds to the state of the pressure chamber 27 shown in FIG. 6A. A residual vibration waveform generating period of FIG. 7 corresponds to the pressure state of the pressure chamber 27 shown in FIG. 6B.

As shown in FIG. 6A, as the drive waveform generated in the drive waveform generator 212 is applied to the piezoelectric element 35 (specifically, electrode of the piezoelectric element connection substrate 36), the piezoelectric element 35 expands and contracts. A stretching force of the piezoelectric element 35 based on the drive waveform changes the pressure in the pressure chamber 27 via the vibration plate 30, which generates the pressure change in the pressure chamber 27 to eject the ink. For example, falling of the drive waveform decreases the pressure in the pressure chamber; on the contrary, rising of the drive waveform increases the pressure in the pressure chamber 27 (see, drive waveform generating period shown in FIG. 7).

As shown FIG. 6B, after the drive waveform is applied to the piezoelectric element 35 (ink droplet has been ejected), the residual vibration occurs in the pressure chamber 27. The residual pressure wave generated in the pressure chamber 27 is propagated to the piezoelectric element 35 via the vibration plate 30. The residual pressure wave is shaped by an attenuation vibration waveform as shown in FIG. 7.

As a result, a residual vibration voltage becomes induced in the piezoelectric element 35 (specifically, electrode of the piezoelectric element connection substrate 36). The residual vibration detector 240 detects the residual vibration voltage and generates a detection result (for example, a digital signal, where the amplitude of the residual vibration is fixed at a peak value, and the amplitude value of the analog signal is converted into the on digital signal) for outputting to the controller 211 as an output of the residual vibration detector 240.

As described above, in the liquid droplet ejecting of the present embodiment, the residual vibration detector 240 detects the residual vibration based on the expansion and contraction of the piezoelectric element 35, and the controller 211 determines the thickness of the ink (how thickened the ink is), based on the output of the residual vibration detector. Herein, since the residual vibration waveform is an attenuation vibration (damping vibration), in order to determine the ink viscosity based on the output of the residual vibration detector 240, an attenuation ratio (damping ratio) of the residual vibration is focused on. By doing so, the liquid droplet ejecting device can discharge the thickened ink from the only nozzle (for which it is determined) that the idle discharge operation is needed.

Figure 8:
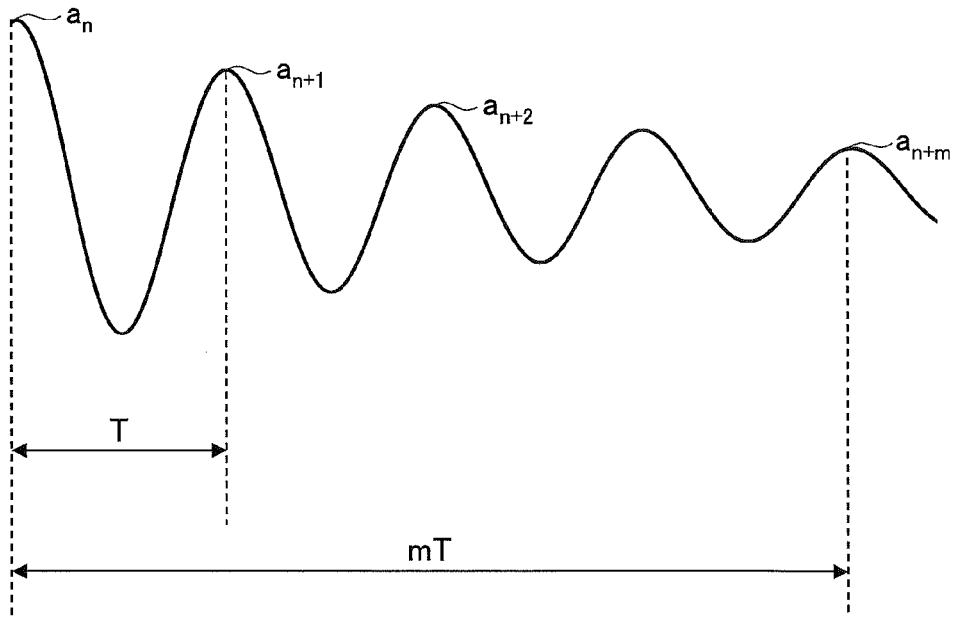
FIG. 8 is a schematic used for calculating an attenuation ratio based on an attenuation vibration waveform.

Next, with reference to FIGS. 8 and 9, a process to calculate an attenuation ratio based on the attenuation vibration waveform shown in FIG. 7 and a correlation between the amplitudes of the residual vibration waveform and the ink viscosity are described below. FIG. 8 is a schematic used for calculating an attenuation ratio based on an attenuation vibration waveform.

An ideal formula of an attenuation vibration is represented as the following formula 1.

$$x = e^{-\zeta\omega_0 t}\left(x_0\cos\omega_d t + \frac{\zeta\omega_0 x_0 + v_0}{\omega_d}\sin\omega_d t\right) \tag{1}$$

Wherein, x represents a vibration displacement, relative to a time t, x0 represents an initial displacement, ζ represents an attenuation ratio, ω0 represents a natural vibration frequency, ωd represents a natural vibration frequency for an attenuation system, $v_0$ represents an initial changing amount, and t represents a time.

Herein, the natural vibration frequency ωd for the attenuation system is represented as the following formula 2.

$$\omega_d = \sqrt{1-\zeta^2}\,\omega_0 \tag{2}$$

As a parameter that is required for calculating the attenuation ratio ζdet, a logarithm attenuation ratio δ exists. The logarithm attenuation ratio δ is represented by the following formula 3.

$$\delta = \frac{1}{m}\cdot\ln\frac{a_n}{a_{n+m}} \tag{3}$$

In the formula 3 and FIG. 8, αn represents "n"-th amplitude value, and αn+m represents "n+m"-th amplitude value. In FIG. 8, T represents one cycle, the logarithm attenuation δ represents a value that is acquired by logarithmic transforming a rate of the amplitude change, dividing the logarithmic transformed value by m, and averaging per cycle. The numbers n and m are natural number.

The attenuation ratio ζ is calculated by dividing the logarithm attenuation ratio δ by 2π, as shown in the following formula 4.

$$\zeta = \frac{\delta}{2\pi} \tag{4}$$

That is, the attenuation ratio ζ has the information that the attenuation ratio of the amplitude values for the multiple cycles is averaged by 1 cycle.

Thus, based on the formulas 1 through 4, the attenuation ratio ζ may be calculated by acquiring the logarithm attenuation ratio δ, so this process is required to merely detect at least two amplitudes of the residual vibration waveform.

Figure 9:
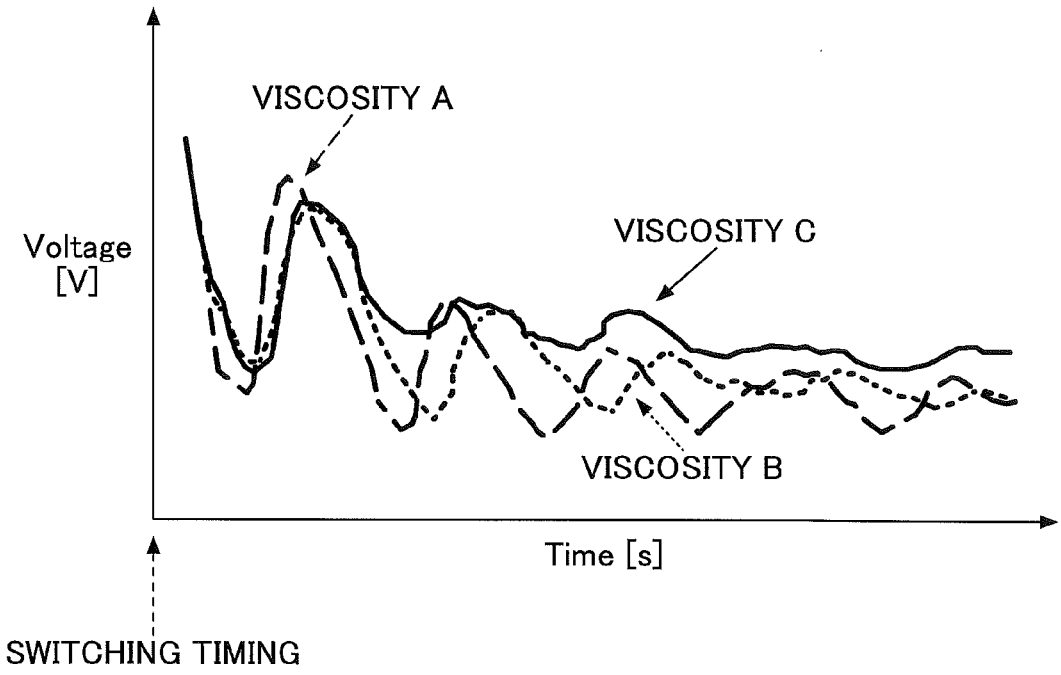
FIG. 9 is a graph illustrating a measured residual vibration waveform and ink viscosities.

FIG. 9 is a graph illustrating a measured residual vibration waveform when several different ink viscosities are used. Specifically, the graph shows the changes in the measured residual vibration waveforms when three types of ink viscosities are used. In FIG. 9, a horizontal axis indicates a time [s], and a vertical axis indicates a voltage [V]. 0 points shows a switching timing when the drive waveform applying period is switched to the residual vibration waveform generating period. The magnitude relation of the respective ink viscosities is the condition that a viscosity A is set to be 1, a viscosity B is 1.7, and a viscosity C is 3.

As is clear from FIG. 9, the amplitude of the measured residual vibration waveform whose viscosity A is set to be 1 is largest, and the amplitude of the measured residual vibration waveform whose viscosity C is set to be 3 is smallest, That is, the lower the viscosity of the ink, the larger the amplitude of the attenuation vibration or the smaller the attenuation ratio. In other words, the measure residual vibration waveform is correlated to the ink viscosity (thickness of the ink).

Figure 10:
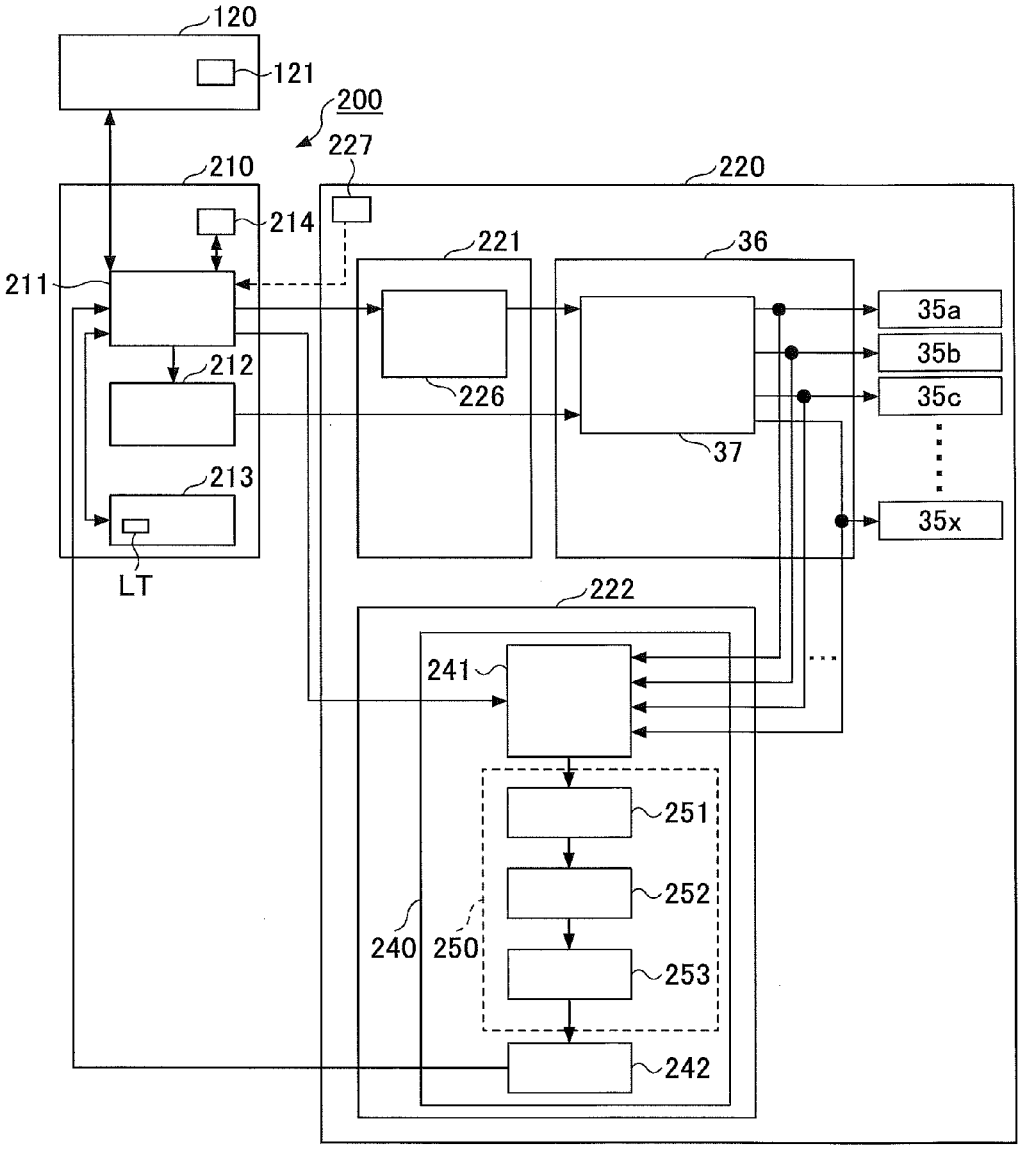
FIG. 10 is an entire block diagram illustrating a liquid droplet ejecting device according to the first embodiment.

FIG. 10 is an entire block diagram illustrating a drive control of the inkjet recording module 200 of the present embodiment, to be installed in the inkjet recording apparatus 100.

The inkjet recording module (liquid droplet ejecting device) 200 includes the drive control substrate 210 and the inkjet recording head 220, and so on. The drive control substrate 210 is provided with the controller 211, a drive waveform generator 212, and a memory 213, and a nozzle memory 214. The inkjet recording head 220 includes a head substrate 221 to which the controller 226 is installed, a residual vibration detecting substrate 222 to which the residual vibration detector 240 is installed, a piezoelectric element connection substrate 36 to which the piezoelectric driving element IC 37 is installed, and the piezoelectric elements 35 (35*a* through 35*x*). A waveform processing circuit 250, a switching element 241, and an AD converter 242 are installed on the residual vibration detecting substrate 222. The waveform processing circuit 250 includes a filter circuit 251, an amplification circuit 252, and a peak-hold circuit 253.

The entire or a part of functions of the controller 211 installed in the driving control substrate 210 and the controller 226 installed in the head-side substrate 221 may be provided in either one of the substrate 210 or 221 collectively. The entire or a part of functions installed in the residual-vibration detecting substrate 222 may be provided in the drive control substrate 210 or the head-side substrate 221 collectively.

The controller 211 generates a timing control signal and drive wave data, based on the image data transmitted from a host controller (for example, a controller 120 of the inkjet recording apparatus 100), to the drive waveform generator 212. The controller 211 transmits a timing control signal (digital signal) to the piezoelectric-element driving IC 37 and the switching element 241 via serial communication, and also transmits a switching signal that is in synchronized with the timing control signal for transmitting to the switching element 241. By synchronizing the switching signal with the timing control signal, the timing at which the residual vibration voltage that is induced in the piezoelectric element 35 (electric pad of the piezoelectric element connection substrate 36) is fetched in the residual-vibration detecting substrate 222, can be controlled.

In addition, the controller 211 selects at least two the residual vibration (multiple cycles) (digital values) from the output values (the amplitude values of the residual vibration held by the peak-hold circuit 253 are converted into digital values). Then, the controller 211 calculates the attenuation ratio of the damping vibration, using conversion formulas (formulas 1 through 4 as mentioned above). The more number of the selected amplitude, the higher the calculation accuracy of the attenuation ratio, The controller 211 calculates the attenuation ratio based on the amplitude values, and compares the detected attenuation ratio with data of the attenuation ratio stored in the memory 213. Thus, the change of the ink viscosities (ink thickness) in the respective pressure chamber 27 is detected with a high degree with accuracy. Then, the controller 211 sets a suitable idle discharge waveform for each the respective nozzle 20, and drives the piezoelectric elements 35 (35*a* through 35*x*). In short, the controller 211 determines the necessity of the idle discharge operation and selects the idle discharge waveform; and accordingly, the ink droplet can be ejected only from the nozzle for it is determined that the idle discharge is necessary.

The drive waveform generator 212 converts the generated drive waveform data from digital to analog, and amplifies a voltage and a current of the analog data.

The memory 213 stores the data relating to the attenuation ratio, such as, a look-up table indicating a correlative relation between the attenuation ratio and the ink viscosity, in advance.

The nozzle memory 214 stores the nozzles for which the controller 213 determines that the idle ejection is needed.

An inquiry unit 121 reports to an operator that the corresponding nozzle is in the no-ejecting state. When the controller 211 determines that there is a nozzle where the effect cannot be expected by the liquid-state recovery ejection (idle discharge), the inquiry unit 121 functions as a selection unit selects (ask operators) whether printing is to be started or stopped or whether printing is to be continued or stopped.

The temperature detector 227, provided in the inkjet recording head 220, detects an ink temperature. The controller 211 may use the detected ink temperature for determining the thickness of the ink.

The controller 226 de-serializes the timing control signal for transmitting to the piezoelectric-element driving IC 37.

The piezoelectric-element driving IC 37 is turned ON/OFF in accordance with the timing control signal. For example, in the period during which the piezoelectric-element driving IC 37 is ON, the drive waveform generated in the drive waveform generator 212 is applied to the piezoelectric element 35 (see drive waveform applying period, as illustrated in FIG. 9). In the period during which the piezoelectric-element driving IC 37 is OFF, the drive waveform generated in the drive waveform generator 212 is not applied to the piezoelectric element 35. The piezoelectric element 35 contracts and expands based on the falling and the rising of the drive waveform so as to eject the ink droplet from the respective nozzles in response to the driving of the piezoelectric element 35.

In the waveform processing circuit 250, the filter circuit 251 and the amplification circuit 252 remove the noise (filter process) and amplify the voltage waveforms after the filter-processed waveform. The peak-hold circuit 253 recognizes and extracts peak values (e.g., maximum values) of the amplified waveform and holds the peak values for the predetermined time.

Further, the switching element 241 is connected so that the waveform processing circuit 250 and the piezoelectric elements 35 can be connected and disconnected. For example, when the piezoelectric element 35 are connected to the waveform processing circuit 250 by the switching element 241, the waveform processing circuit 250 fetches the amplitude values of the residual vibration waveform induced in the electrode of the piezoelectric element connection substrate 36.

The AD converter 242 converts the held amplitude values of the residual vibration held by the wave processing circuit 250 (peak-hold circuit 253) into digital value, for outputting to (feedback) the controller 211. The controller 211 (or the controller 226) calculates the attenuation ratio based on the output of the fed-back residual vibration detector 240 that is fed back from the AD converter 242.

Herein, in FIG. 10, although the residual vibration voltages of the multiple piezoelectric elements 35 are detected by one group of the switching element 241, the waveform processing circuit 250, and the AD converter 242, while switching subsequently; alternatively, the configuration is not limited above. For example, multiple groups of switching elements, waveform processing circuits, and AD converters may be provided so that the number of the groups is same as the number of the piezoelectric elements 35, and the ink viscosity state of all nozzles (pressure chambers) may be detected at the same time. Further alternatively, all of the piezoelectric elements 35 are divided into some groups, where a switching element, a waveform processing circuit, and an AD converter are used for each of the groups.

Detecting targets may be sequentially switched within the groups. With this configuration, the number of the pressure chambers for which the ink viscosity is detected at the same time can be increased, and the number of the circuits can be reduced.

Figure 11:
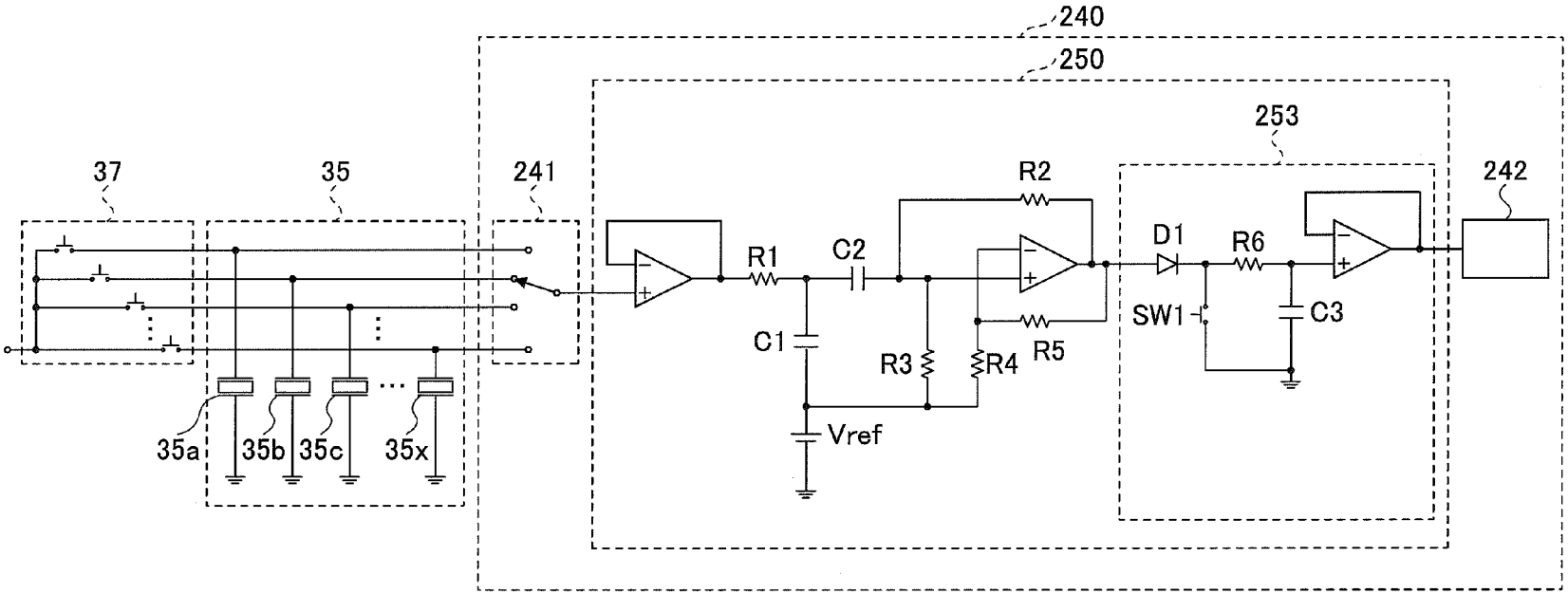
FIG. 11 is circuitry illustrating a residual vibration detecting substrate of the liquid droplet device according to the first embodiment.

FIG. 11 is circuitry illustrating the residual-vibration detecting detector 240 of the present embodiment.

The piezoelectric-element driving IC 37 includes multiple switching elements, and switching ON/OFF of the piezoelectric-element driving IC 37 is based on switching ON/OFF of the switching elements corresponding to the respective piezoelectric elements 35*a* through 35*x*. After the ink has been on ejected, at the time when the piezoelectric-element driving IC 37 is tuned OFF, the switching element 241 is switched so that the piezoelectric element 35 is connected to the waveform processing circuit 250. By doing so, the waveform processing circuit 250 can recognize the amplitude values of the residual vibration waveform.

In the waveform processing circuit 250, a buffer unit having a high-impedance receives the slightly small residual vibration waveforms, which suppresses adversely effect of the circuit of detection circuit (the residual vibration detector 240) to the residual vibration waveforms. Herein, it is preferable that passive element constants of resistors R1 through R5 and capacitors C1 though C3, included in the waveform processing circuit 250, be configured to be variably controlled by the controller 211, depending on the difference in the natural vibration frequency due to the characteristics of the inkjet recording head 220.

The filter circuit 251 performs filter process onto the residual vibration waveform. The characteristics of the filter circuit 251 are designed so that a certain constant passing bandwidth is present, setting a natural vibration frequency determined by the recording head 220 as a central frequency. Further, for example, the filter circuit 251 sets bandwidth of "−3 dB" from both ends of the passing bandwidth so that sensitivity is approximately three times that of the passing bandwidth. With this setting, variation in the natural vibration frequency caused by production tolerance of the head can be absorbed, and the noise in the high frequency band and the low-frequency band efficiently can be removed. Accordingly, removing the noise components efficiently and extracting the signal components can be achieved.

Figure 12:
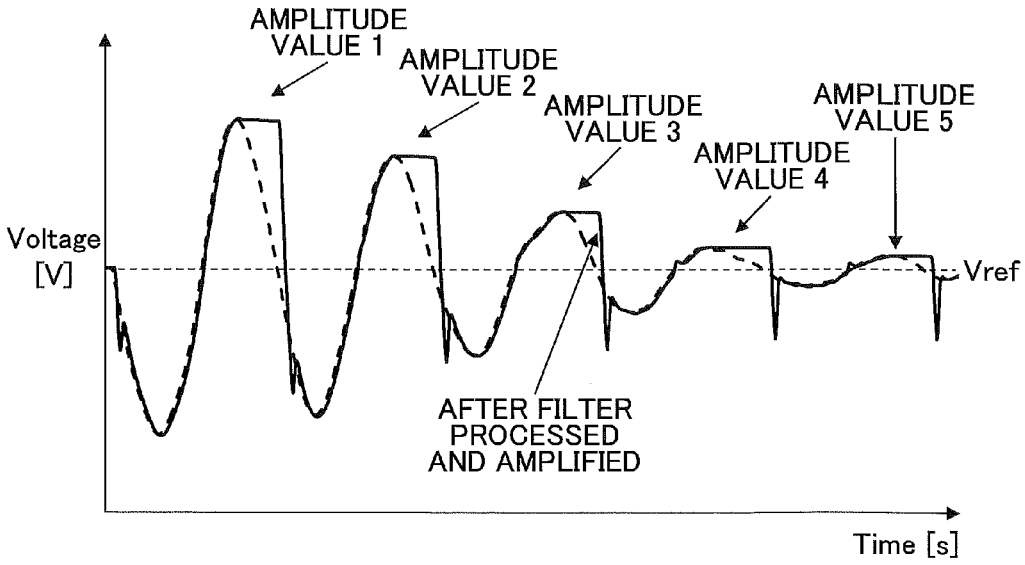
FIG. 12 is a graph illustrating a residual vibration waveform according the first embodiment.

The amplification circuit 252 amplifies the residual vibration after filter process (see broken line shown in FIG. 12). An amplification degree of the amplification circuit 252 is set so that the amplified waveforms can be within an input enable range of the AD converter 242.

The filter circuit 251 and the amplification circuit 252 are configured with a band-pass filter amplification type, generally called Sallen-Key type. With this configuration, removing the noise component and abstracting the signal component can be performed effectively. However, the configuration is not limited above. The filter circuit and the amplification circuit can be constituted by a combination circuit that includes at least a fitter having a high-pass characteristics and a low-pass characteristics and a non-inverting amplifier or an inverting amplifier The peak-hold circuit 253 recognizes and extracts the peak values of the residual vibration waveform, and holds the value at the peak values (see, solid line FIG. 12). The resistor R6 and the capacitor C3 of the peak-hold circuit 253 control the value (reset value) so that a discharge period is less than (or equal to) one half of the residual vibration cycle. The resistor R6 and the capacitor C3 of the peak-hold circuit 253 control the value (reset value) so that a discharge period is less than (or equal to) one-half of the residual vibration cycle.

The reset operation in the peak-hold circuit 253 is performed by transmitting the reset signal from the head-side controller 226 to the switching element 241, for example, at the timing when the rising of the attenuation vibration waveform crosses the reference voltage Vref. The reset timing is the timing as long as peak-hold circuit 253 can recognize the amplitude of the attenuation vibration waveform. For example, in or to detect the reset timing, a comparator (not shown) may be used. Herein, the circuit configuration of the peak-hold circuit 253 is not limited to the above; if it only includes the function to hold the peak value of the amplitude of the residual vibration waveform, the other configuration is applicable.

FIG. 12 is a graph illustrating a waveform while the amplitude values are detected by using the circuit of FIG. 11 of the present embodiment. In FIG. 12, a broken line represents a waveform of the amplified residual vibration. The solid line represents the waveform waveforms whose peak values of the amplitude are held.

In FIG. 12, five peak values are held. For example, amplitude 1 represents an amplitude of a first half waveform, an amplitude 2 represents an amplitudes of a second first half waveform, an amplitude 3 represents an amplitude of a third half waveform, amplitude 4 represents an amplitude of a fourth half waveform, and amplitude 5 represents an amplitude of a fifth half waveform. The rapid drop of the waveform positioned lower than the reference voltage Vref indicate an undershoot situation caused by instantly discharging the capacitance of the capacitor C3.

The attenuation ratio ζ can be calculated based on at least two amplitude values selected from the five amplitudes 1 through 5, using the above-described formulas (3) and (4). FIG. 12 shows a detected waveform including first through fifth half waveforms in an upper side of vertical amplitudes (upper amplitude values), and this example, the attenuation ratio ζ is calculated by averaging 4 cycles. Alternatively, the attenuation ratio ζ may be calculated by detecting a lower side of vertical amplitudes (lower amplitude values).

When the attenuation ratio ζ may be calculated by detecting the upper side of vertical amplitudes, the waveform processing circuit 250 is constituted by an amplitude circuit method. Alternatively, when the attenuation ratio ζ may be calculated by detecting the lower side of vertical amplitudes, the waveform processing circuit 250 may be constituted by a reverse amplitude circuit method.

Herein, by selecting the amplitude values for use appropriately, attenuation ratio can be calculated with a higher degree of accuracy. For example, the controller 211 can calculate the attenuation ratio, by excluding the amplitudes 1 of the first half wave where it is more likely to be affected by the variation in the switching element 241 and then by averaging the amplitudes (2, 3, 4, and 5) per cycle. Alternatively, the attenuation ratio ζ may be calculated based on the amplitudes (1, 2, 3, and 4) for the multiple cycles excluding the smallest amplitude value (e.g., amplitude 5) where the detection error is more likely to be greater. With this control, by removing the amplitude having relatively low signal component, the calculated accuracy of the attenuation ratio can be improved.

Yet alternatively, by excluding both the amplitude 1 and the amplitude 5, the attenuation ratio ζ may be calculated. Further yet alternatively, the controller 211 can calculate the attenuation ratio, by excluding the amplitude value that is more likely to be affected by a large external disturbance and a large noise, then by averaging the amplitude values after excluding for multiple cycles.

Figure 13:
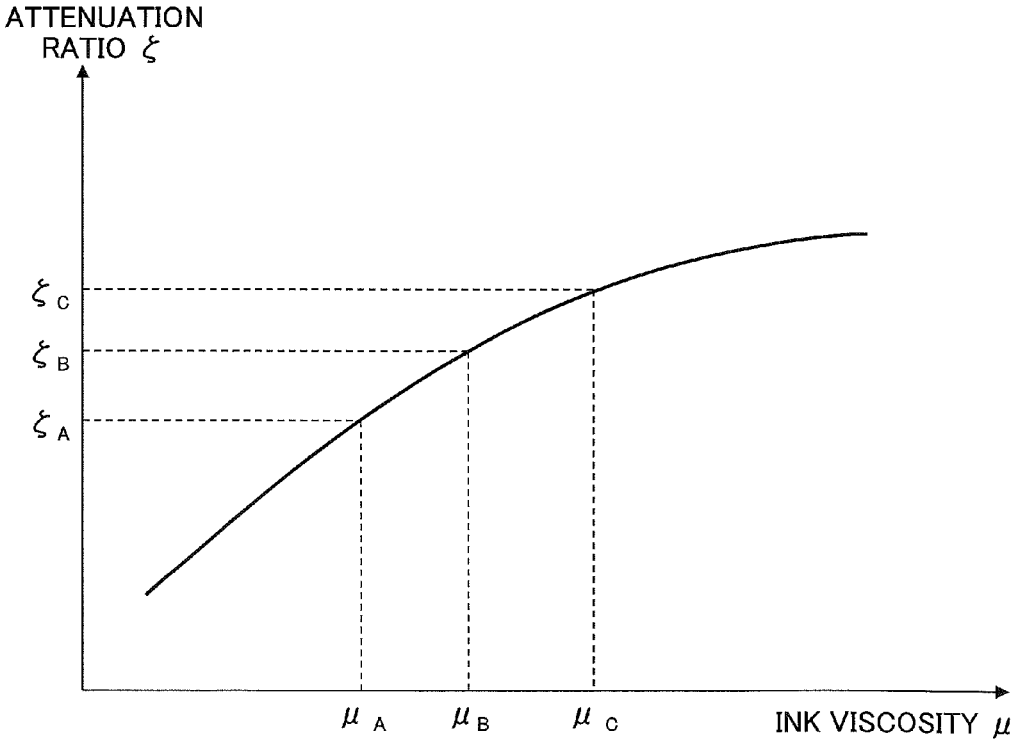
FIG. 13 is a graph illustrating a correlation between an attenuation ratio $\zeta$ and ink viscosity $\mu$ according the first embodiment.

FIG. 13 is a graph illustrating a correlation between the attenuation ratio ζ calculated by using the amplitude values (amplitudes 1, 2, 3, 4, and 5) of FIG. 12 and the ink viscosity μ.

As is clear from FIG. 13, the correlation of and the e attenuation ratio ζ and the ink viscosity μ is that, as the ink viscosity μ is increased, the on attenuation ratio ζ is increased.

The controller 211 applies an appropriate idle discharge waveform to the piezoelectric elements 35 (35*a* through 35*x*) corresponding to the respective nozzles 20 for drive, based on the changes in the ink viscosities μ. The controller 211 determines the ink viscosities (ink thickness) and the necessity of the liquid-state recovery ejection, and selects (sets) the appropriate idle discharge waveform, based on the determined ink thickness.

As one example, the controller 211 compares the residual vibration detected from one nozzle (first nozzle) with the residual vibrations detected from other nozzles (second nozzles) positioned near the one nozzle. Then, the controller 211 compares the ink thickness corresponding to the nozzle whose viscosity is greatest in the vicinity with the ink thickness indicating "thickened" shown in FIG. 13 to determined how thickened the ink is.

Herein, in advance, the controller 211 prepares the multiple drive waveforms for idle discharge corresponding to the degrees of ink viscosities. For example, a look up table shows the correlation between the thickness of the ink and the drive waveform for the idle discharge (for example, no-idle discharge, idle-discharge waveform A, and idle-discharge waveform B)). Based on the setting, the controller 211 determines the thickness of the ink (and the necessity of the liquid-state recovery ejection), and appropriately sets the drive waveform for the liquid-state recovery ejection, referring (collating) the attenuation ratio (damping ratio) with a look up table.

Alternatively, the controller 211 corrects a reference idle discharge waveform that is prepared in advance, to set the suitable drive waveform for idle discharge.

With this control, the controller 211 can determine the thickness of the ink and setting idle-discharge waveform, with a simple configuration.

As another example, the temperature detector 227 detects the ink temperature. The controller 211 compares the ink viscosity (for example, μA), that usually corresponds to the temperature, with the ink viscosity (thickened) (for example, μA and/or μB) corresponding to the detected temperature, to determine the ink thickness.

Similarly, based on the prepared look up table, the controller 211 determines the thickness of the ink (and the necessity of the liquid-state recovery ejection), and appropriately sets the drive waveform for the liquid-state recovery ejection, collating the attenuation ratio with a look up table.

Alternatively, the controller 211 corrects a reference idle discharge waveform that is prepared in advance, to set the suitable drive waveform for idle discharge.

With this control, by providing the temperature detector 227, the controller 211 can determine the thickness of the ink and setting idle-discharge waveform with a higher degree of accuracy.

As yet another example, the controller 211 uniquely sets the drive waveform for the liquid-state recovery ejection, based on the ink viscosities (for example, ink viscosities μA, μB, μC). Then, the controller 211 selects a drive waveform for liquid-state recovery ejection from multiple drive waveforms for liquid-state recovery ejection prepared (for example, drive waveform μA, drive waveform for μB, drive waveform for μC), in advance, to set the drive waveform for the liquid-state recovery ejection.

In this setting, since the ink viscosity itself is determined as the thickness of the ink, the controller 211 can determine the thickness of the ink and setting idle-discharge waveform, with a simple on configuration, and simple setting. It is to be noted that, the determination ignores how changed the ink viscosity is.

As described above, by determining the thickness of the ink, the controller 211 can select a suitable idle ejection waveform from several waveforms prepared in advance, in accordance with the state of the meniscus. For example, a slight drive waveform that vibrates the surface (meniscus) of ink (slightly drives) such that the ink is not ejected, multiple idle ejection waveforms (corresponding to multiple amounts of ejection for adjusting), and a strong idle ejection waveform corresponding to strong continuous discharge of the thickened ink, and so on, may be used as the idle ejection waveform (prepared waveform).

In the liquid-droplet ejecting head according to the present embodiments, after the surface (meniscus) of ink is vibrated (slightly driven) such that the ink is not ejected, or after the ink is ejected, the residual vibration occurring within the ink in the pressure chamber is detected. Effectively using the detected residual vibration and the damping ratio that is calculated from the residual vibration, the thickness of the ink near the openings of the nozzle can be accurately determined. Accordingly, in the inkjet recording apparatus having the liquid-droplet ejection device installed, the ink droplet is discharged only from the nozzle where the idle discharge is needed, which can suppress the waste consumption of the ink. Furthermore, the meniscus of the ink can be kept at the suitable position.

[Control Flowchart]

Figure 14:
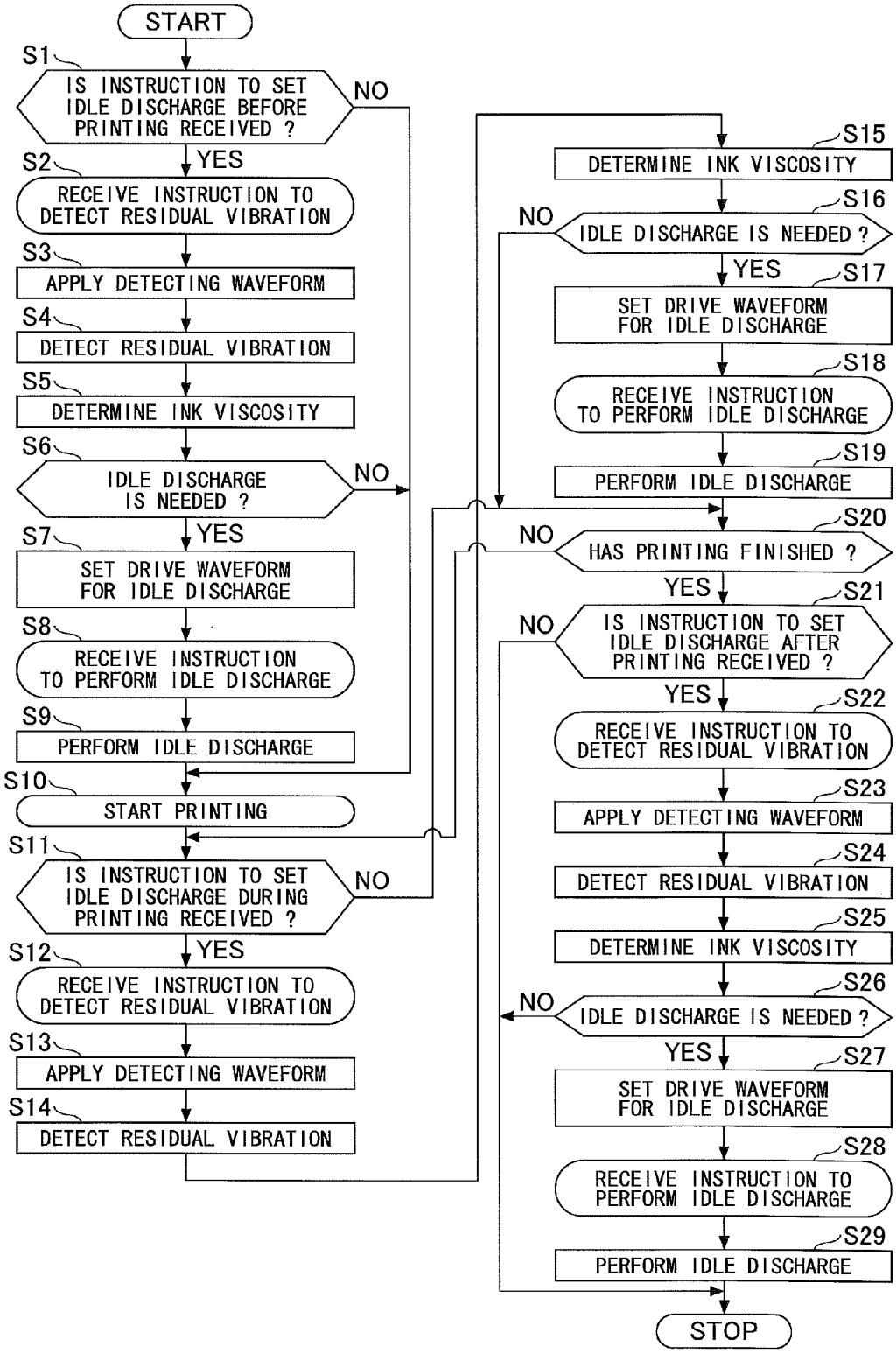
FIG. 14 is a control flowchart in an inkjet recording apparatus according to the first embodiment.

FIG. 14 is a flowchart illustrating an on-demand type, line-scanning inkjet recording apparatus 100 according to the present embodiment. The control process shown in flowchart of FIG. 14 is performed by the controller 211, in accordance with the control program.

At step S1, a host controller determines whether or not the idle discharge of the ink before printing is needed based on the elapsed time from when the previous printing has been finished, and based on the ambient temperature and humidity. When the host controller determines that the idle discharge before printing is needed (YES at S1), the controller 211 executes the process in step S2. When the host controller determines that the idle discharge before printing is not needed (NO at S1), the controller 211 executes the process in step S10.

At step S2, the controller 211 receives an instruction signal to detect the residual vibration, instructed from the host controller.

At step S3, the controller 211 applies a detecting waveform (driving waveform for detecting), for detecting residual vibration, to a piezoelectric element 35. Herein, it is preferable that the detecting waveform be a slight drive waveform that causes the meniscus (surface of the ink) in the nozzle 20 to vibrate slightly so that the liquid droplet is not ejected. However, a driving waveform for detecting, that is different from the drive waveform for printing, to eject the ink that does not affect image forming, or also may be the drive waveform for printing, are used for the detecting waveform.

At step S4, the residual vibration detector 240 detects the residual vibration occurring within the pressure chamber 27 corresponding to the nozzles 20 after the detecting waveform is applied.

At step S5, the controller 211 calculates the damping ratio from the detection result (amplitude value) in the detection of the residual vibration. Then, the controller 211 determines the ink viscosities, referring to the damping ratio and the look up table, or the controller 211 converts the damping ratio into a calculated result, using a conversion formula, to determine the ink viscosities. The necessity of the liquid-state recovery ejection is determined for each nozzle, or by calculation, using the calculated attenuation ratio, and determines how thickened the ink in respective nozzles is (the thickness of the ink for each nozzle). The determination of the increase in the controller 211 can refer to the above-described description.

At step S6, the controller 211 determines the necessity of the liquid-state recovery ejection for each nozzle, based the thickness of the ink. When the controller 211 determines that liquid-state recovery ejection (idle discharge) is needed (YES), the process proceeds to step S7. When the controller 211 determines that the idle discharge is not needed (NO), the controller 211 does not cause the idle ejection to be performed.

At step S7, the controller 211 sets idle discharge waveform data, that is, the drive waveform for the liquid-state recovery ejection for idle discharging, based on the thickness of the ink. As for the setting of the drive waveform, the controller 211 selects one drive waveform for idle discharging from multiple drive waveforms for idle discharging defined in a lookup table (corresponding table between the thickness of the ink and the types of the drive waveforms). Alternatively, the controller 211 corrects a reference idle discharge waveform prepared in advance, to set the suitable idle discharge waveform data. At step S8, the controller 211 receives an instruction signal to perform the idle discharge, instructed from the host controller.

At step S9, the controller 211 performs the idle discharge operation, using the idle discharge waveform data set at step S7. The idle discharge operation may be performed multiple times if needed. Alternatively, in order to confirm the effect of the idle discharge operation before printing, the processes from steps S1 to S9 may be executed multiple times. Thus, before printing, determining the necessity of the idle discharge operation and selecting the idle discharge waveforms can be suitably performed.

Herein, the inkjet recording apparatus 100 may include a selection unit (inquiry unit 121) to ask the user whether the printing is started and whether the printing operation is to be continued. Before printing, when the host controller determines that the effect from the idle discharge operation is not expected, based on the output of the residual vibration detector 240, the selection unit asks the user whether the printing is started and whether the printing operation is continued. By including the selection unit, the unnecessary decrease in the availability of the inkjet recording apparatus 100 can be avoided.

At step S10, the controller 211 instructs the inkjet recording apparatus 100 that printing be started.

At step S11, the host controller determines that the idle discharge operation is needed at fixed intervals. When the host controller determines that the idle discharge operation is periodically needed (YES), the controller 211 performs the process at step S12. When the host controller determines that the idle discharge operation is not periodically needed (NO), the controller 211 executes the process at step S20.

At step S12, the controller 211 receives the instruction signal to detect the residual vibration, from the host controller.

At step S13, the controller 211 (drive waveform generator 212) applies a detecting waveform (driving waveform for detecting), for detecting residual vibration, to the piezoelectric element 35. Herein, it is preferable that the detecting waveform be a slight drive waveform that causes the meniscus (surface of the ink) in the nozzle 20 to vibrate slightly so that the liquid droplet is not ejected. However, a driving waveform for detecting, that is different from the drive waveform for printing, to eject the ink that does not affect the image forming, or also may be the drive waveform for printing, are used for the detecting waveform.

At step S14, the residual vibration detector 240 detects the residual vibration occurring within the pressure chamber 27 corresponding to the nozzles 20 after the detecting waveform is applied. If the star-flushing operation is performed, the flushing candidate nozzle is limited to the nozzle that does not affect the image forming, and the residual vibration is detected for only the limited nozzles.

At step S15, the controller 211 calculates the damping ratio from the detection result (amplitude value) in the detection of the residual vibration. Then, the controller 211 determines the ink viscosities, referring to the damping ratio and the look up table, or the controller 211 converts the damping ratio into a calculated result, using a conversion formula, to determine the ink viscosities. Then, controller 211 determines the thickness of the ink for each nozzle.

At step S16, the controller 211 determines the necessity of the liquid-state recovery ejection for each nozzle, based the thickness of the ink. When the controller 211 determines that liquid-state recovery ejection (idle discharge) is needed (YES), the process proceeds to step S17. When the controller 211 determines that the idle discharge is not needed (NO), the controller 211 does not cause the idle ejection to be performed.

At step S17, the controller 211 sets idle discharge waveform data, that is, the drive waveform for the liquid-state recovery ejection for idle discharging, based on the thickness of the ink. As for the setting of the drive waveform, the controller 211 selects one drive waveform for idle discharging from multiple drive waveforms for idle discharging defined in a lookup table (corresponding table between the thickness of the ink and the types of the drive waveforms). Alternatively, the controller 211 corrects a reference idle discharge waveform prepared in advance, to set the suitable idle discharge waveform data.

At step S18, the controller 211 receives an instruction signal to perform the idle discharge from the host controller.

At step S19, the controller 211 performs the idle discharge operation, using the idle discharge waveform data set at step S17. The idle discharge operation may be performed multiple times if needed. Alternatively, in order to confirm the effect of the idle discharge operation, the processes from steps S11 to S19 may be executed multiple times.

Thus, during printing, when the line flushing is performed for the area that does not affect the image forming, by reducing the unnecessary idle discharge, the cost of the inkjet recording apparatus 100 can be reduced.

At step S20, the controller 211 instructs the inkjet recording apparatus that printing be started. At step S20, the host controller determines whether the printing is stopped or not. When the host controller determines that the liquid-state recovery ejection is needed after the printing is finished (YES), the controller 211 executes the process at step S21. When the host controllers determines that the liquid-state recovery ejection is not needed on after the printing is finished (YES), the process in the controller 211 returns to the process at step S22.

At step S21, a host controller determines whether or not the idle discharge of the ink after printing is needed based on the types of the printed image, using frequency of the nozzle, printing types, and the ambient temperature and humidity. When the host controller determines that the idle discharge after printing is needed (YES), the controller 211 executes the process in step S22.

When the host controller determines that the idle discharge after printing is not needed (NO), the controller 211 stops the process.

Herein, using the nozzles is different in the respective image formation process, and the using frequencies of the nozzle are different. Therefore, the entire inkjet head 220 cannot be kept in uniform state. In order to solve this problem, by executing the idle discharge operation, all the nozzles 20 are refreshed, and the dedicated cap can be wet with the ink.

At step S22, the controller 211 receives the instruction signal to detect the residual vibration detection transmitted from the host controller.

At step S23, the controller 211 applies a on detecting waveform (driving waveform for detecting), for detecting residual vibration, to a piezoelectric element 35. Herein, it is preferable that the detecting waveform be a slight drive waveform that causes the meniscus (surface of the ink) in the nozzle 20 to vibrate slightly so that the liquid droplet is not ejected. However, a driving waveform for detecting, that is different from is the drive waveform for printing, to eject the ink that does not affect to form image, or also may be the drive waveform for printing, are used for the detecting waveform.

At step S24, the residual vibration detector 240 detects the residual vibration occurring within the pressure chamber 27 corresponding to the all nozzles 20 after the detecting waveform is applied.

At step S25, the controller 211 calculates the damping ratio from the detection result (amplitude value) in the detection of the residual vibration. Then, the controller 211 determines the ink viscosities, referring to the damping ratio and the look up table, or the controller 211 converts the damping ratio into a calculated result, using a conversion formula, to determine the ink viscosities. The controller 211 determines the thickness of the ink for each nozzle.

At step S26, the controller 211 determines the necessity of the liquid-state recovery ejection for each nozzle, based the thickness of the ink. When the controller 211 determines that liquid-state recovery ejection (idle discharge) is needed (YES), the process proceeds to step S27. When the controller 211 determines that the idle discharge is not needed (NO), the controller 211 does not cause the idle ejection to be performed.

At step S27, the controller 211 sets idle discharge waveform data, that is, the drive waveform for the liquid-state recovery ejection for idle discharging, based on the thickness of the ink. As for the setting of the drive waveform, the controller 211 selects one drive waveform for idle discharging from multiple drive waveforms for idle discharging defined in a lookup table (corresponding table between the thickness of the ink and the types of the drive waveforms. Alternatively, the controller 211 corrects a reference idle discharge waveform prepared in advance, to set the suitable idle discharge waveform data.

At step S28, the controller 211 receives an instruction signal to perform the idle discharge from the host controller At step S29, the controller 211 performs the idle discharge operation, using the idle discharge waveform data set at step S27. The idle discharge operation may be performed multiple times if needed. Alternatively, in order to confirm the effect of the idle discharge operation before printing, the processes from steps S21 to S29 may be executed multiple times. Thus, after printing, the determination of necessity of the idle discharge operation and selection of the waveform for idle discharge waveforms can be suitably performed.

If the host controller 211 determines that the idle discharge operation is unnecessary, at the timing when the idle discharge operation is executed, before printing, during printing, and after printing, the controller 211 applies a pulse voltage having a peak voltage value smaller than that of the driving pulse voltage, to the piezoelectric element so that the ink is not ejected from the nozzle 20. Thus, by applying the pressure such that the ink is not ejected from the nozzle 20 to the ink within the pressure chamber 27, the thickened ink is agitated (stirred) inn the pressure chamber 27. As a result, the thickness of the ink can be moderated. In this case, the controller 211 may set slightly driving waveform data, instead of setting the drive waveform data for idle discharge, or may include the slightly driving waveform data as a part of the idle discharge waveform data for idle discharge, to selectively drive the piezoelectric elements 35 based on the printing data.

Alternatively, if the host controller determines that the viscosity of the ink is increased such that the recovery cannot be expected by performing the idle discharge operation, the process of the controller 211 proceeds to the recovery sequences (different from the idle discharge), such as, compressing ink, sucking ink, and wiping the nozzle surface. Then, the ink having greater viscosity can be discharged. In addition, the controller 211 predicts the nozzle stopping ejecting during printing, and reports to an operator that the corresponding nozzle is in the not ejecting state. In this case, the controller 211 is equipped with a memory (nozzle memory 214) to store which nozzle is unnecessary for idle discharge operation. By doing so, after printing, the user can confirm the corresponding nozzle(s) using the memory.

Yet alternatively, when the controller 211 determines that the effect of the idle discharge operation is not expected, by proceeding to the recovery operation of the nozzle, the printing for which the image is not formed due to not ejecting can be prevented. Moreover, the controller 211 may execute the idle discharge operation for the candidates of the limited nozzle that is expected from which the ink (liquid) droplet is ejected. In this case, in the star-flushing operation, the adversely effect on the image forming region can be alleviated.

Further alternatively, the configuration can be set such that the user can select performing the recovery operation and types of these recovery operations. With this setting, unnecessary maintenance recovery operation is deleted, and the availability of the inkjet recording apparatus 100 can be improved.

Second Embodiment

In a second embodiment, the configuration of the piezoelectric element installed in the inkjet recording head 220 is different from that of the first embodiment. Differing from the piezoelectric elements according to the first embodiment, the piezoelectric element according to the second embodiment includes a driving piezoelectric element and a supporting (pillar) piezoelectric element.

Figure 15:
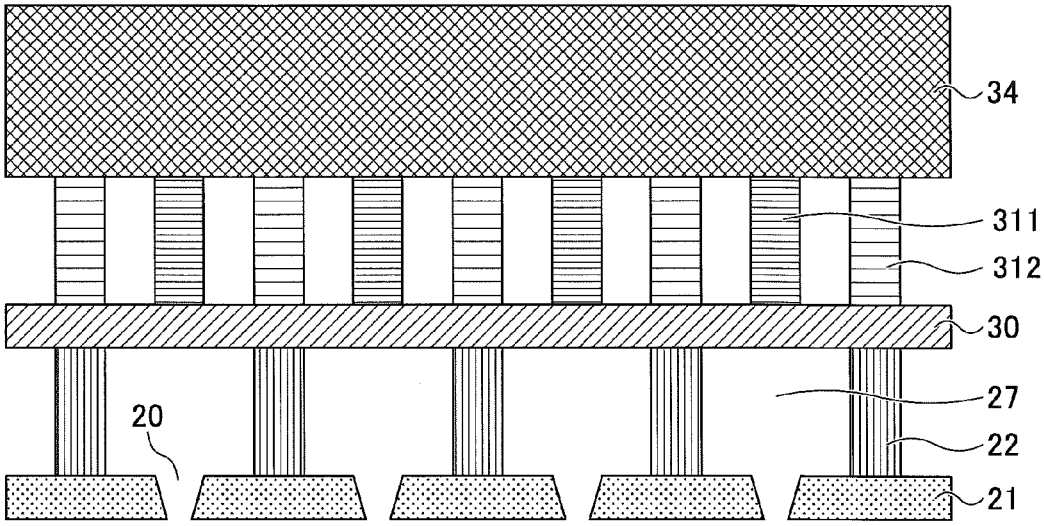
FIG. 15 is a schematic cross-sectional view illustrating one example of the inkjet recording head according to a second embodiment of the present invention.

FIG. 15 is a schematic cross-sectional view illustrating one example of the inkjet recording head 220 according to the second embodiment.

As illustrated in FIG. 15, the piezoelectric elements include driving piezoelectric elements (pressure generating elements) 311 and supporting piezoelectric elements (pillar elements) 312, where the driving piezoelectric elements 311 and the supporting piezoelectric element 312*s* are alternately provided. The driving piezoelectric element 311 is formed in a position facing the openings of the pressure chamber 27 via the vibration plate 30. The supporting piezoelectric element 312 is formed in a position facing partitions of the pressure chamber 27 via the vibration plate 30.

With the configuration of FIG. 15, not only the driving piezoelectric element 311 but also the supporting piezoelectric element 312 can be used for detecting the residual vibration. More specifically, the supporting piezoelectric elements 312 are always used for detecting the residual vibration. In addition, when the piezoelectric element 311 is not being driven (when driving the driving piezoelectric element 311 does not affect the ejection), the driving piezoelectric element 311 may be used for detecting the residual vibration.

Accordingly, in the line scanning type inkjet recording apparatus 100, the flexibility of the timing to detect the residual vibration during printing is increased. Thus, the required time to detect the ink viscosities of the all nozzles 20 (residual vibration detection time) can be shortened. Further, it is unnecessary to provide additional sensors, so the inkjet recording head 220 can have a simple configuration.

Moreover, with the configuration of FIG. 15, even though the position deviation may occur when the vibration plate 30 contacts the piezoelectric elements 311, the character fluctuation occurring in the piezoelectric elements may be minimized. Thus, the splashing performance (ejecting performance) to splash the ink in the inkjet recording head 220 can be made stable.

Herein, although the configuration of the piezoelectric element is not limited to the configuration shown in FIG. 15, the configuration is applicable so that the supporting piezoelectric on element 312 can detect the residual vibration, independently from the driving piezoelectric element 311. Alternatively, in order to use all the piezoelectric elements for detecting the residual vibration, additional sensors may be provided.

Figure 16:
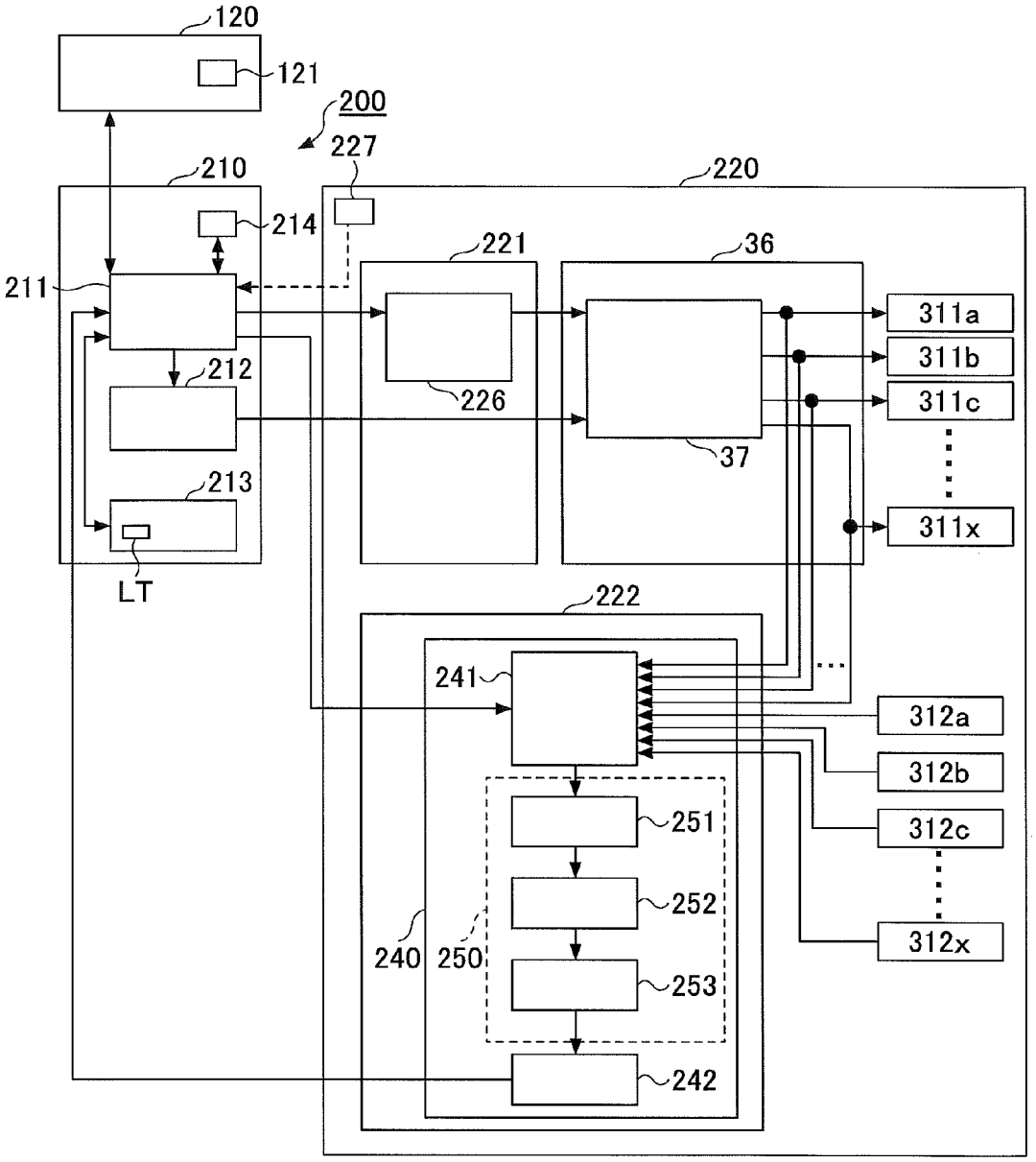
FIG. 16 is a block diagram illustrating one example of a liquid droplet ejecting device, to be installed in the inkjet recording apparatus according to the second embodiment.

FIG. 16 is a block diagram illustrating one example of an inkjet recording head module (liquid droplet ejecting device) according to the second embodiment, to be installed in the inkjet recording apparatus 100.

As illustrated in FIG. 16, the driving piezoelectric element 311 (driving piezoelectric elements 311*a* through 311*x*), which are connected to the piezoelectric element driving IC 37 and the switching member 241, are controlled based on the drive waveforms output from the piezoelectric driving IC 37. The driving piezoelectric element 311 is controlled by the piezoelectric element driving IC 37 such that, the residual vibration is not detected when the piezoelectric element 311 is being driven (during ejecting ink), and the residual vibration is detected when the piezoelectric element 311 is not being driven.

As illustrated in FIG. 16, the supporting piezoelectric elements 312 (supporting piezoelectric elements 312*a* through 312*x*), which are connected to the switch 241, are controlled based on the switching signals output from the controller 211. Thus, the supporting piezoelectric element 312 is controlled by the piezoelectric element driving IC 37 such that residual vibration is always detected.

It is to be noted that, although FIG. 16 shows a configuration in which not only the supporting piezoelectric element 312 but also the driving piezoelectric element 311 detects the residual vibration, the residual vibration can be detected only by the supporting piezoelectric elements 312. That is, using the driving piezoelectric element 311 is not required for detecting the residual vibration.

The present invention is not limited to the specifically disclosed embodiments, and variations and modifications may be made without departing from the scope of the present invention. The scope of the inventive subject matter should be determined with reference to the appended claims, along with the full scope of equivalents to which such claims are entitled.

What is claimed is:

1. A liquid droplet ejecting device comprising:

multiple pressure chambers communicating with multiple nozzles, to contain liquid;

a vibration plate, to constitute elastic walls of the pressure chambers, disposed extending along the pressure chambers;

multiple pressure generating elements disposed facing the multiple chambers respectively via the vibration plate;

a drive waveform generator to generate drive waveform data that indicates a shape of a drive waveform for driving the multiple pressure generating elements;

a residual vibration detector to detect a residual vibration waveform occurring within the pressure chamber after the pressure generating elements are driven; and a controller to determine the necessity of liquid-state recovery ejection for discharging thickened liquid, based on the detected residual vibration, and to cause the liquid-state recovery ejection to be performed upon determining that liquid-state recovery ejection is needed;

wherein the necessity of the liquid-state recovery ejection is determined for each nozzle;

wherein the drive waveform data is selected from a plurality of the drive waveform data based on an output of the residual vibration detector, the drive waveform data is selected for the nozzle for which it is determined that the liquid-state recovery ejection is needed; and wherein the pressure generating elements are driven based on the selected drive waveform data.

2. The liquid droplet ejecting device as claimed in claim 1, wherein when there is the nozzle for which it is determined that the liquid-state recovery ejection is needed based on the detected residual vibration, the controller sets the drive waveform for the liquid-state recovery ejection for applying to the pressure generating element corresponding to the nozzle for which it is determined that the liquid-state recovery ejection is needed.

3. The liquid droplet ejecting device as claimed in claim 1, wherein when the nozzle for which it is determined that the liquid-state recovery ejection is not needed based on the detected residual vibration, the controller sets a slight drive waveform that drives the pressure generating element corresponding to the nozzle slightly so that the liquid droplet is not ejected.

4. The liquid droplet ejecting device as claimed in claim 1, further comprising a sensor, different from the pressure generating element, that is used for detecting the residual vibration.

5. The liquid droplet ejecting device as claimed in claim 1, further comprising multiple pillar elements disposed facing the multiple pressure chambers via the vibration plate, used for detecting the residual vibration.

6. The liquid droplet ejecting device as claimed in claim 1, wherein the controller calculates a damping ratio based on the detected residual vibration.

7. The liquid droplet ejecting device as claimed in claim 6, wherein, referring to the damping ratio with a look up table, the controller determines the necessity of the liquid-state recovery ejection and sets the drive waveform for the liquid-state recovery ejection.

8. The liquid droplet ejecting device as claimed in claim 6, wherein the controller converts the damping ratio into a calculated result, using a conversion formula, to determine the necessity of the liquid-state recovery ejection and set the drive waveform for the liquid-state recovery ejection, based on the calculated result.

9. The liquid droplet ejecting device as claimed in claim 1, wherein the controller compares the residual vibration detected from a first nozzle with the residual vibrations detected from a second nozzles positioned near the first nozzle, to determine the necessity of the liquid-state recovery ejection and set the drive waveform for the liquid-state recovery ejection.

10. The liquid droplet ejecting device as claimed in claim 1, further comprising a temperature detector, wherein, the controller determines the necessity of the liquid-state recovery ejection and sets the drive waveform for the liquid-state recovery ejection, based on the output of the temperature detector and the detected residual vibration.

11. The liquid droplet ejecting device as claimed in claim 1, wherein the controller uniquely determines the necessity of the liquid-state recovery ejection and uniquely sets the drive waveform for the liquid-state recovery ejection, based on the detected residual vibration.

12. The liquid droplet ejecting device as claimed in claim 1, wherein the controller selects a drive waveform for liquid-state recovery ejection from multiple drive waveforms for liquid-state recovery ejection prepared in advance, to set the drive waveform for the liquid-state recovery ejection.

13. The liquid droplet ejecting device as claimed in claim 1, wherein the controller corrects a reference drive waveform, to set the drive waveform for the liquid-state recovery ejection.

14. The liquid droplet ejecting device as claimed in claim 1, wherein, after liquid-state recovery ejection is executed, the controller determines the necessity of the liquid-state recovery ejection again and sets the drive waveform for liquid-state recovery ejection again.

15. The liquid droplet ejecting device as claimed in claim 1, wherein determining the necessity of the liquid-state recovery ejection and setting the waveform for liquid-state recovery ejection are performed only for the candidate of the nozzles for performing the liquid-state recovery ejection.

16. The liquid droplet ejecting device as claimed in claim 1, further comprising a memory, wherein, when the controller determines that there is a nozzle where the effect cannot be expected by the liquid-state recovery ejection, the memory stores the nozzle ineffectiveness.

17. An inkjet recording apparatus comprising the liquid droplet ejecting device as claimed in claim 1.

18. The inkjet recording apparatus as claimed in claim 17, further comprising a selection unit, wherein, when the controller determines that there is a nozzle where the effect cannot be expected by the liquid-state recovery ejection, the selection unit selects whether printing is to be started or stopped or whether printing is to be continued or stopped.

19. A liquid droplet ejecting method for a liquid droplet ejecting device that includes multiple pressure chambers communicating with multiple nozzles, to contain liquid; a vibration plate, to constitute elastic walls of the pressure chambers, disposed extending along the pressure chambers; multiple pressure generating elements disposed facing the multiple chambers respectively via the vibration plate; a drive waveform generator to generate drive waveform data that indicates a shape of a drive waveform for driving the multiple pressure generating elements; and a residual vibration detector to detect a residual vibration waveform occurring within the pressure chamber after the pressure generating elements are driven; the method comprising:

determining the necessity of liquid-state recovery ejection for discharging thickened liquid, based on the detected residual vibration; and performing the liquid-state recovery ejection upon determining that liquid-state recovery ejection is needed;

wherein the necessity of the liquid-state recovery ejection is determined for each nozzle;

wherein the drive waveform data is selected from a plurality of the drive waveform data based on an output of the residual vibration detector, the drive waveform data is selected for the nozzle for which it is determined that the liquid-state recovery ejection is needed;

wherein the pressure generating elements are driven based on the selected drive waveform data.

* * * * *